US009645547B2

(12) United States Patent
Minoshima

(10) Patent No.: US 9,645,547 B2
(45) Date of Patent: May 9, 2017

(54) VENTILATION PORT FOR IMAGE FORMING APPARATUS COVER

(71) Applicant: Brother Kogyo Kabushiki Kaisha, Nagoya-shi, Aichi-ken (JP)

(72) Inventor: Saya Minoshima, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/050,519

(22) Filed: Feb. 23, 2016

(65) Prior Publication Data

US 2016/0246252 A1 Aug. 25, 2016

(30) Foreign Application Priority Data

Feb. 23, 2015 (JP) ..... 2015-033141

(51) Int. Cl.
*G03G 21/00* (2006.01)
*G03G 21/20* (2006.01)
*G03G 21/16* (2006.01)

(52) U.S. Cl.
CPC ..... *G03G 21/206* (2013.01); *G03G 21/1623* (2013.01)

(58) Field of Classification Search
CPC ..... G03G 21/1623; G03G 21/1676
See application file for complete search history.

(56) References Cited

U.S. PATENT DOCUMENTS 4,967,239 A * 10/1990 Sakakura ..... G03G 15/0935 399/320
2010/0329747 A1* 12/2010 Kouda ..... G03G 15/0877 399/262
2010/0329757 A1* 12/2010 Souda ..... G03G 21/1671 399/381
2014/0328606 A1* 11/2014 Katsuyama ..... G03G 15/0189 399/92

FOREIGN PATENT DOCUMENTS

JP H11218987 A 8/1999
JP 2013011743 A 1/2013

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

An image forming apparatus to form an image electrophotographically is provided. The image forming apparatus includes a housing formed to have an opening; a cover being movable between an open position and an exposing position and having a ventilation port, through which air is allowed to flow; a cartridge having a developer roller and being detachably attached to a body of the image forming apparatus through the opening; a discharging fan arranged on an opposite side from the opening across the cartridge; a handle arranged on the cartridge to extend from the cartridge in a direction toward the opening in an upper position with respect to the ventilation port, when the cartridge is attached to the body and the opening is covered by the cover; and a facing part arranged on the cover to face the handle in a vertically displaced position with respect to the handle.

8 Claims, 7 Drawing Sheets

VENTILATION PORT FOR IMAGE FORMING APPARATUS COVER

CROSS REFERENCE TO RELATED APPLICATION

This application claims priority from Japanese Patent Application No. 2015-033141, filed on Feb. 23, 2015, the entire subject matters of which are incorporated herein by reference.

BACKGROUND

Technical Field

An aspect of the present disclosure relates to an image forming apparatus capable of forming an image electrophotographically on a sheet.

Related Art

An image forming apparatus having a ventilation path to draw cooling air inside is known. The ventilation path may be formed in a guide member, which guides a sheet being conveyed, to draw the cooling air underneath a processing cartridge.

SUMMARY

When a speed to form an image in an image forming apparatus increases, a rotation speed for a developer roller in the processing cartridge may also increase, and friction between the developer roller and neighboring parts that contact the developer roller may increase. In this regard, an amount of heat generated in a developer agent container and the developer roller may also increase. When a developer agent, e.g., toner, in the developer agent container is exposed to the heat, the toner may be undesirably softened, and the softened toner may affect an image forming quality.

The present disclosure is advantageous in that an image forming apparatus, in which an area underneath a processing cartridge may be efficiently cooled, is provided.

According to an aspect of the present disclosure, an image forming apparatus configured to form an image electrophotographically is provided. The image forming apparatus includes a housing formed to have an opening; a cover movable between a position to cover the opening and a position to expose the opening, the cover having a ventilation port, through which air is allowed to flow; a cartridge having a developer roller to supply a developer agent, the cartridge being detachably attached to a body of the image forming apparatus through the opening; a discharging fan arranged on an opposite side from the opening across the cartridge; a handle arranged on the cartridge to extend from the cartridge in a direction toward the opening in an upper position with respect to the ventilation port, when the cartridge is attached to the body and the opening is covered by the cover; and a facing part arranged on the cover to face the handle in a vertically displaced position with respect to the handle.

BRIEF DESCRIPTION OF THE ACCOMPANYING DRAWINGS

FIG. 1 is a cross-sectional view of an image forming apparatus 1 according to an embodiment of the present disclosure.

FIG. 2 illustrates arrangement of a developer cartridge 7, a frame 20, a front cover 4, and a housing 3 in the image forming apparatus 1 according to the embodiment of the present disclosure.

FIG. 3 is an enlarged view of a handle 23 and the developer cartridge 7 with neighboring parts in the image forming apparatus 1 according to the embodiment of the present disclosure.

DETAILED DESCRIPTION

Hereinafter, an image forming apparatus 1 according to an embodiment of the present disclosure will be described with reference to the accompanying drawings. It is noted that various connections may be set forth between elements in the following description. These connections in general, and unless specified otherwise, may be direct or indirect, and this specification is not intended to be limiting in this respect.

In the following description, identical parts or items may be referred to by a same reference sign, and redundant explanation of those will be omitted. A quantity of each element, part, or item is, unless specified otherwise, at least one. The present embodiment may not necessarily be limited to the embodiment described below.

1. Overall Configuration of the Image Forming Apparatus

Figure 1:
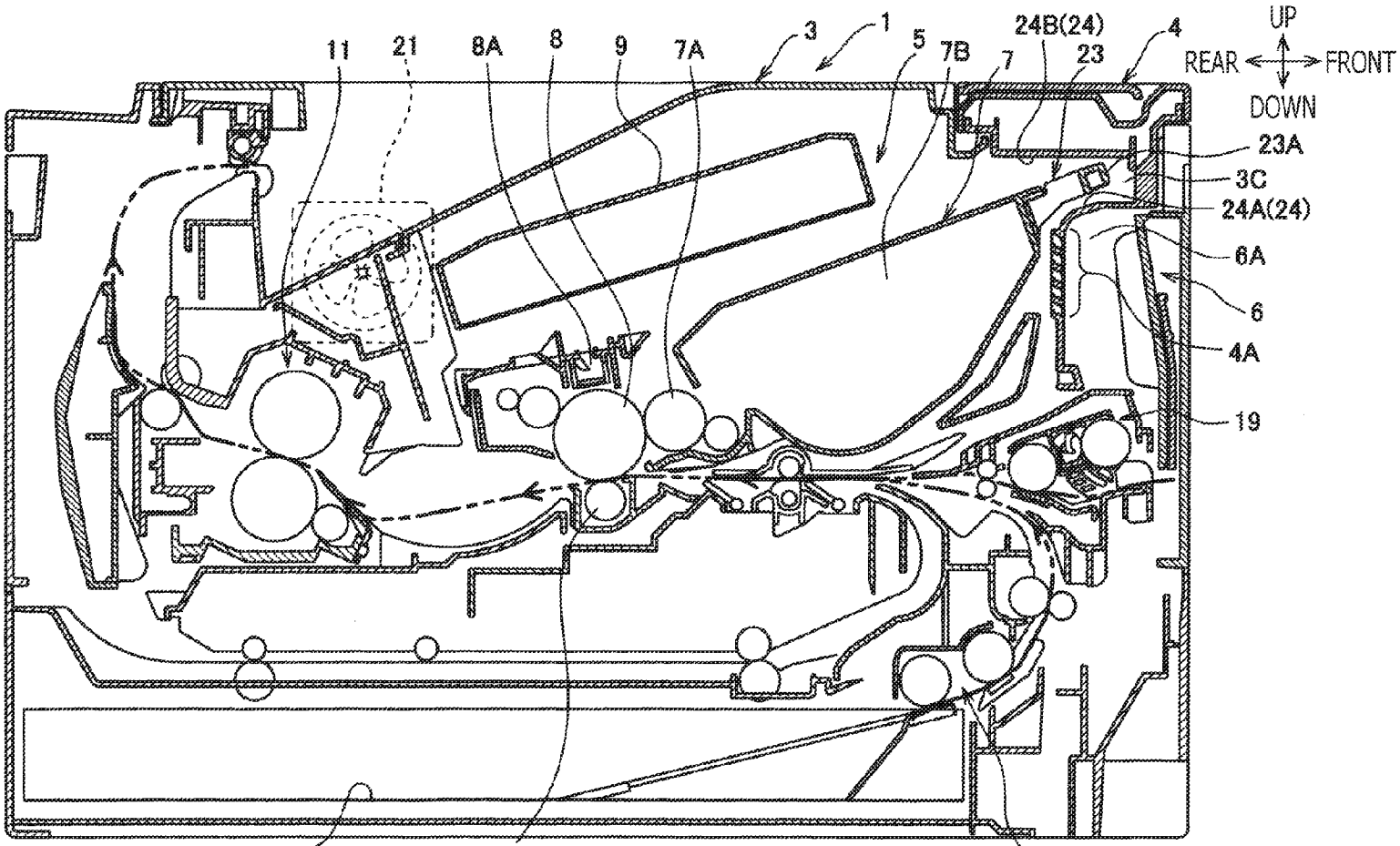

The image forming apparatus 1 may be a monochrome printing apparatus. In the following description, directions concerning the image forming apparatus 1 and each part or item included in the image forming apparatus 1 may be mentioned based on orientations indicated by arrows shown in FIG. 1. For example, a viewer's right-hand side and left-hand side in FIG. 1 are defined as a front side and a rear side, respectively. An upper side and a lower side in FIG. 1 correspond to an upper side and a lower side of the image forming apparatus 1 respectively. A viewer's nearer side and farther side correspond to a leftward side and a rightward side. A right-to-left or left-to-right direction of the image forming apparatus 1 may also be referred to as a widthwise direction. An up-to-down or down-to-up direction may also be referred to as a vertical direction. A front-to-rear or rear-to-front direction may be referred to as a front-rear direction or a direction of depth.

As shown in FIG. 1, the image forming apparatus 1 includes a housing 3, which accommodates an image forming unit 5 to form an image on a sheet. The image forming unit 5 may be an electro-photographic printing unit having a developer cartridge 7, a photosensitive drum 8, an exposure device 9, and a fixing device 11.

The developer cartridge 7 includes a developer roller 7A and a container 7B. The photosensitive drum 8 carries a developer agent on a surface thereof. A charger 8A electrically charges the surface of the photosensitive drum 8. The exposure device 9 emits light to selected areas on the electrically charged surface of the photosensitive drum 8 to form a latent image thereon.

The developer roller 7A supplies the developer agent stored in the container 7B to the exposed areas on the surface of the photosensitive drum 8. Thereby, the latent image is developed on the photosensitive drum 8. Meanwhile, in a position to face the photosensitive drum 8, arranged is a transfer roller 13.

The transfer roller 13 serves to transfer the image carried on the photosensitive drum 8 onto the sheet when the sheet is conveyed between the photosensitive drum 8 and the transfer roller 13. The fixing device 11 heats the image in the developer agent transferred onto the sheet, either directly or indirectly, and thermally fixes the image on the sheet.

In an upstream position from the image forming unit 5 with regard to a conveying direction to convey the sheet, arranged is a first feeder unit 15. The first feeder unit 15 feeds sheets placed on a feeder tray 17 one-by-one to the image forming unit 5. On the feeder tray 17, one or more sheets to be fed to the image forming unit 5 may be placed. The feeder tray 17 is detachably attached to a body of the image forming apparatus 1 at a lower position with respect to the image forming unit 5. The body of the image forming apparatus 1 may refer to parts, which should not be removed or disassembled by a user during ordinary use of the image forming apparatus 1, and may include the housing 3 and a frame 20 (see FIG. 2).

Figure 2:
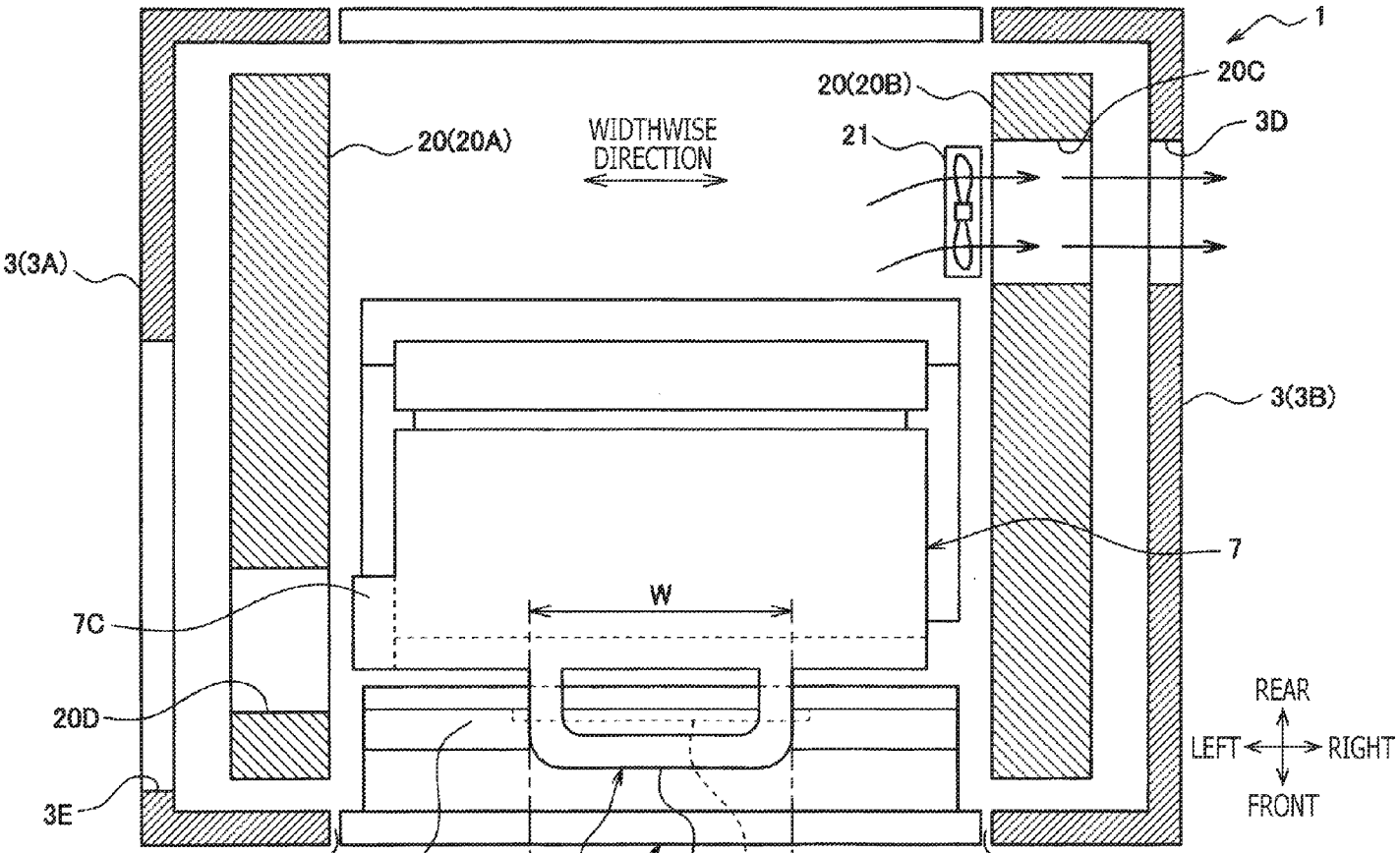

As shown in FIG. 2, the frame 20 includes a pair of plates 20A, 20B, which may be formed in, for example, metal or resin. The frame 20, or the pair of plates 20A, 20B, are covered laterally by side covers 3A, 3B, respectively.

The side covers 3A, 3B are parts of the housing 3 that form exterior lateral faces of the image forming apparatus 1. The lateral faces of the housing 3 may refer to portions that are on ends of a width, which ranges in parallel with a rotation axis of the developer roller 7A. Therefore, a direction in parallel with the rotation axis of the developer roller 7A may be referred to as a widthwise direction in the present embodiment.

In the present embodiment, the widthwise direction coincides with the right-left direction in the image forming apparatus 1. Meanwhile, the sheet is conveyed in the image forming apparatus 1 along a horizontal direction and a direction orthogonal to the widthwise direction, e.g., the front-rear direction. The horizontal and orthogonal direction with respect to the widthwise direction may be referred to as the conveying direction.

On one side of the housing 3 with regard to the conveying direction, e.g., on a front side of the housing 3, the housing 3 has an opening portion, in which an opening 3C is formed. A front cover 4 to cover the opening 3C is attached to the housing 3. The front cover 4 is movable between a covering position (see FIG. 3), in which the front cover 4 covers the opening 3C, and an open position (see FIG. 4), in which the opening 3C is exposed. The front cover 4 is pivotably attached to the frame 20 at a lower end thereof to pivot about the lower end between the covering position and the open position.

Figure 4:
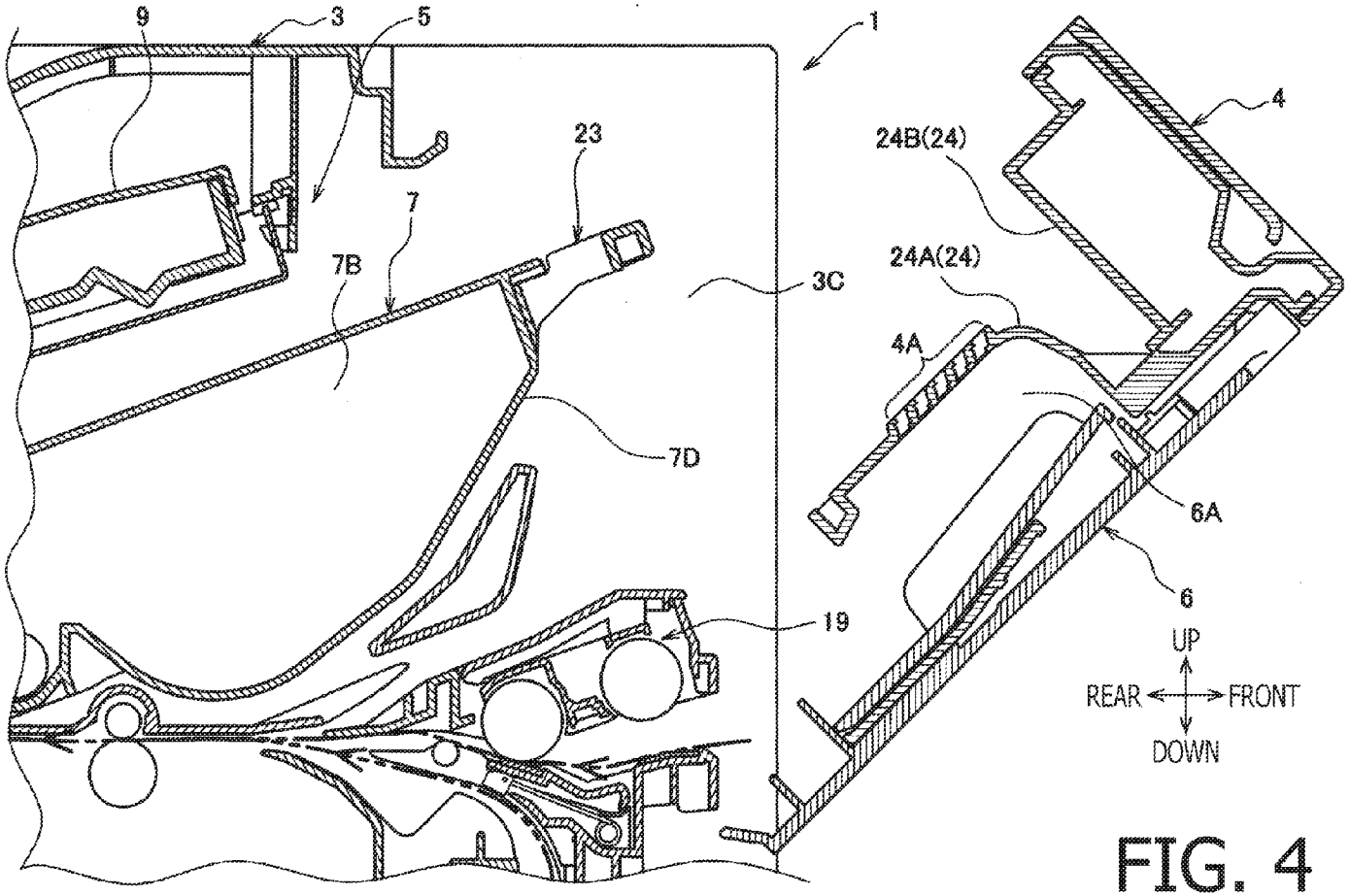
FIG. 4 illustrates the front cover 4 being open in the image forming apparatus 1 according to the embodiment of the present disclosure.

The developer cartridge 7 may be detachably attached to the body of the image forming apparatus 1 through the opening 3C. As shown in FIG. 4, when the front cover 4 is pivoted outward in a direction along the conveying direction, e.g., frontward, the opening 3C is exposed. Therefore, the user may attach or detach the developer cartridge 7 to or from the housing 3 through the exposed opening 3C while the opening 3C is exposed.

Figure 3:
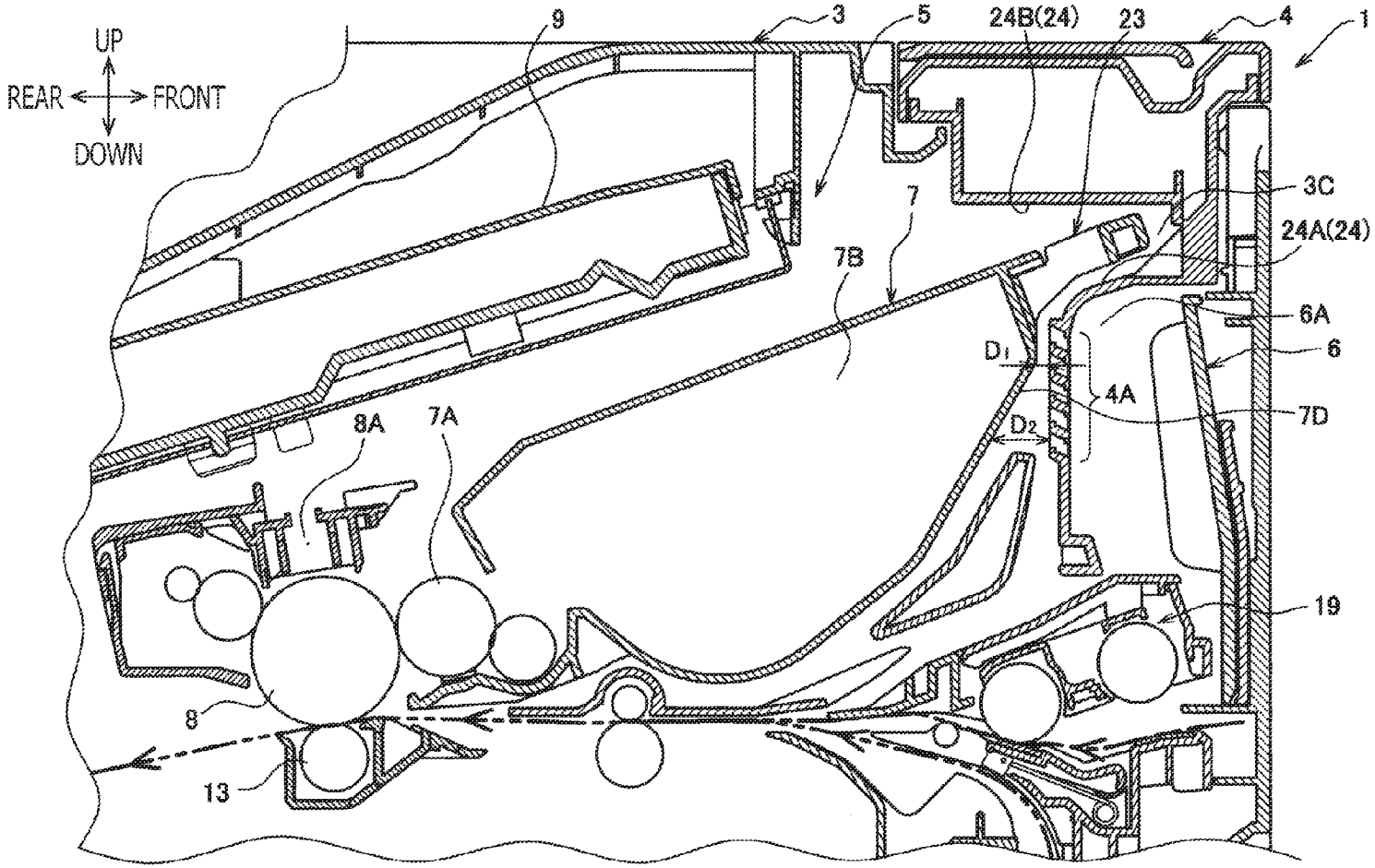
Figure 5:
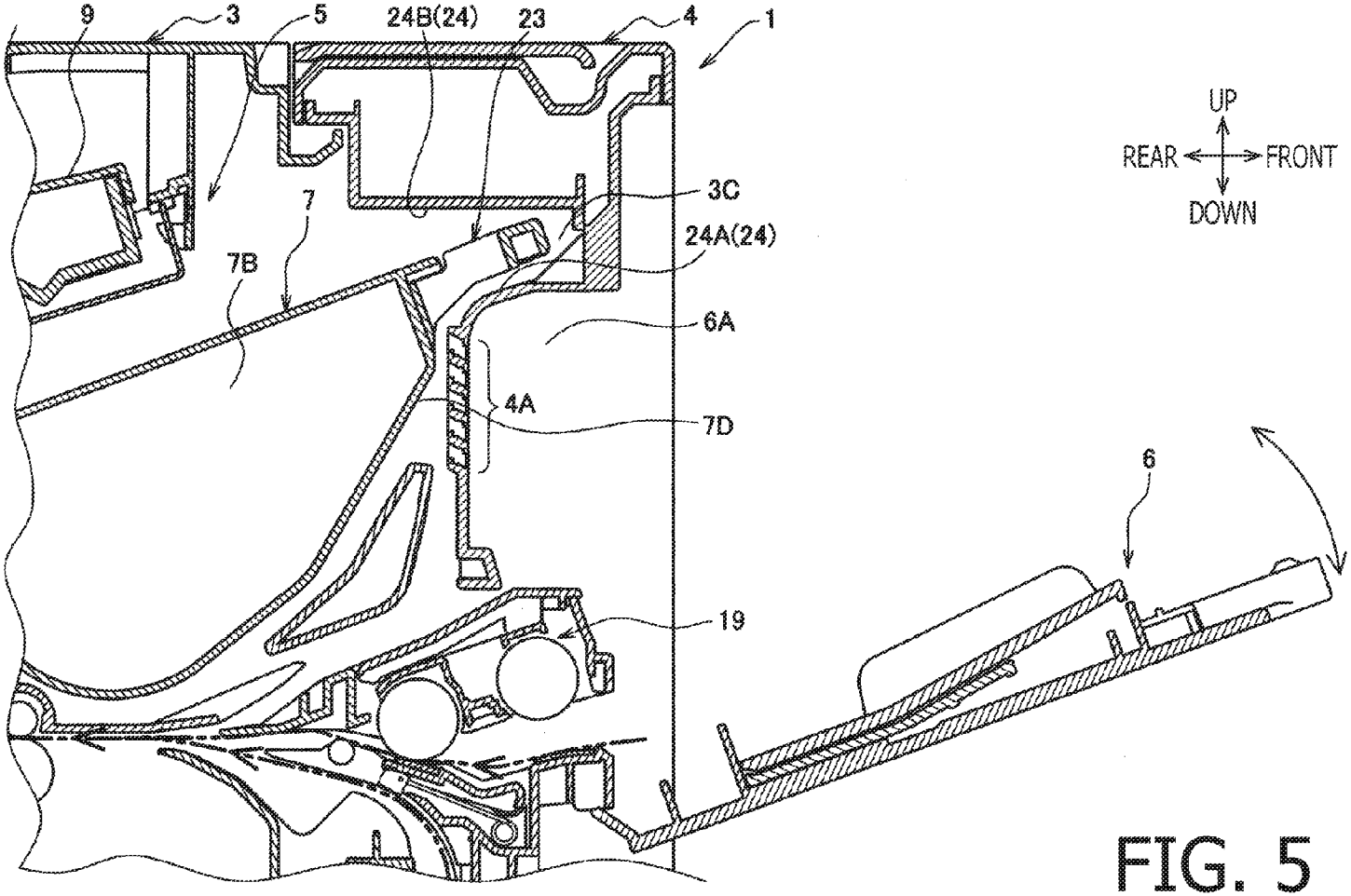
FIG. 5 illustrates a manual-feeder tray 6 being in a usable condition in the image forming apparatus 1 according to the embodiment of the present disclosure.

On a front side of the front cover 4, as shown in FIG. 3, formed is a recess 6A, in which a part of a manual-feeder tray 6 is stowed. The manual-feeder tray 6 is pivotable about a lower end thereof to pivot with respect to the front cover 4 (see FIG. 5).

When the manual-feeder tray 6 is pivoted outward in a direction along the conveying direction, e.g., frontward, to expose the recess 6A, the user may place a sheet on the manual-feeder tray 6. The sheet placed on the manual-feeder tray 6 may be fed to the image forming unit 6 by a second feeder unit 19.

2. Air Ventilation Structure in the Hosing

As shown in FIG. 3, the front cover 4 is formed to have a ventilation port 4A, through which air may flow. The ventilation port 4A is a through hole, or a slit, formed at the recess 6A bored through the front cover 4. The ventilation port 4A may include a plurality of slits.

As shown in FIG. 2, on an opposite side e.g., on the rear side, from the opening 3C across the developer cartridge 7 along the conveying direction, arranged is a fan 21 to discharge the air in the housing 3 outside.

The fan 21 is arranged on one end of the body of the image forming apparatus 1 with regard to the widthwise direction. In the plate 20B and the side cover 3B, which are on the same widthwise end as the fan 21, formed are outlet ports 20C, 3D, through which the air induced by the fan 21 is discharged.

The outlet port 20C is a through hole bored through the plate 20B. The outlet port 3D is a through hole bored through the side cover 3B. The outlet ports 20C, 3D are arranged to at least partly overlap each other, when projected on a hypothetical plane spreading vertically.

On the other end of the body of the image forming apparatus 1 opposite from the outlet ports 20C, 3D with regard to the widthwise direction, in the plate 20A and the side cover 3A, formed are inlet ports 20D, 3E. The inlet ports 20D, 3E are openings formed on the opposite side from the fan 21 across the developer cartridge 7 with regard to the conveying direction to draw the air into the housing 3.

Figure 6:
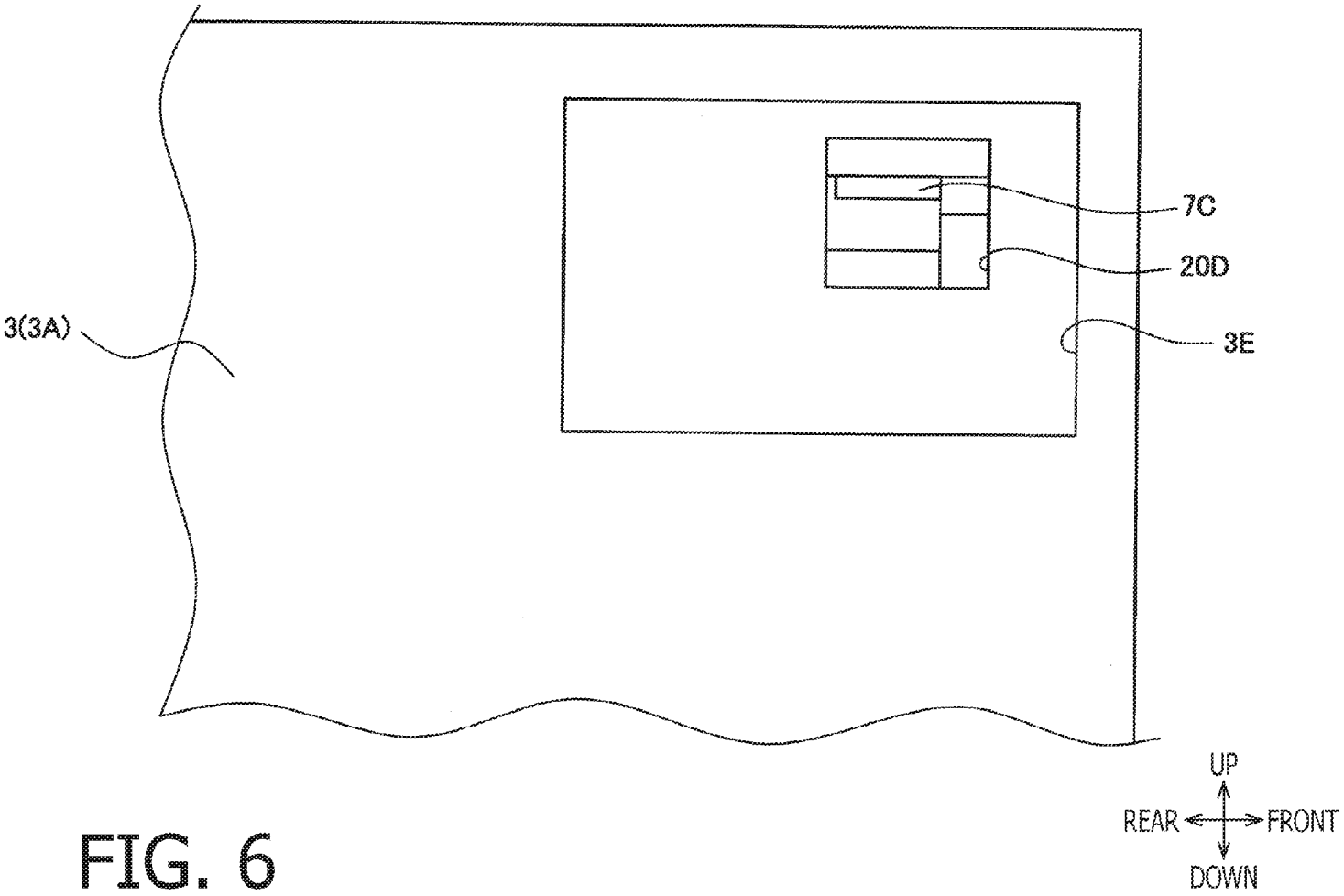
FIG. 6 illustrates arrangement of inlet ports 20D, 3E and a protrusive plate 7C, projected on a hypothetical vertical plane, in the image forming apparatus 1 according to the embodiment of the present disclosure.

The inlet port 20D is a through hole formed through the plate 20A. The inlet port 3E is a through hole formed through the side cover 3A. As shown in FIG. 6, the inlet ports 20D, 3E are arranged to at least partly overlap each other, when projected on a hypothetical plane spreading vertically. The inlet ports 20D, 3E may be in an arrangement such that the projection of the inlet port 20D is enclosed entirely inside the projection of the inlet port 3E on the hypothetical plane.

On one end of the developer cartridge 7 opposite from the side of the fan 21 with regard to the widthwise direction, e.g., on the leftward end of the developer cartridge 7, the developer cartridge 7 has a protrusive plate 7C (see FIG. 2). The protrusive plate 7C is, when the developer cartridge 7 is attached to the body of the image forming apparatus 1, formed on one side of the developer cartridge 7 closer to the inlet ports 20D, 3E with regard to the widthwise direction, to protrude in a direction toward the inlet ports 20D, 3E in a shape of a plate spreading to intersect with the vertical direction (see FIG. 6).

As shown in FIG. 2, the developer cartridge 7 includes a handle 23, which may be gripped by the user when the user attach or detach the developer cartridge 7 to or from the body of the image forming apparatus 1. In the following description, a condition of the developer cartridge 7, in which the developer cartridge 7 is attached to the body of the image forming apparatus 1, and the opening 3C is covered by the front cover 4, will be referred to as an attached condition.

When the developer cartridge 7 is in the attached condition, the handle 23 is, as shown in FIG. 3, in an upper position with respect to the ventilation port 4A and extend from a casing of the developer cartridge 7 in a direction toward the opening 3C, i.e., frontward.

Meanwhile, the front cover 4 includes a facing part 24. The facing part 24 is a part of the front cover 4 that is in a vertically displaced position from the handle 23 to face the handle 23 vertically. The facing part 24 includes a first facing part 24A and a second facing part 24B. The first facing part 24A is a planar portion arranged in a lower position than the handle 23. The second facing part 24B is a planar portion arranged in an upper position than the handle 23. Therefore, when the developer cartridge 7 is in the attached condition, the planar portions to face with the handle 23 are arranged on both sides of the handle 23 with regard to the extending direction of the handle 23.

The first facing part 24A is formed to stretch rearward along a lower surface of the handle 23 toward the developer cartridge 7. Meanwhile, the ventilation port 4A is formed in a portion in the front cover 4 that extends downward continuously from the first facing part 24.

More specifically, the ventilation port 4A is formed at a recessed end, that is, a part of the recess 6A that faces the developer cartridge 7. Therefore, when the developer cartridge 7 is in the attached condition, the ventilation port 4A is in a position closer to the developer cartridge 7, i.e., in a rearward position, than an extended tip end, or a front end, 23A of the handle 23.

The developer cartridge 7 has a slanted face 7D on a side closer to the handle 23 and farther from the developer roller 7A with regard to the conveying direction, e.g., the frontward side. The slanted face 7D is a planar part of the developer cartridge 7 that faces the ventilation port 4A and slants with respect to the vertical direction, when the developer cartridge 7 is in the attached condition.

The slanted face 7D slants to be away from the ventilation port 4A as the slanted face 7D stretches downward. Therefore, when the developer cartridge 7 is in the attached condition, a distance D1 between an upper part in the slanted face 7D and the ventilation port 4A is smaller than a distance D2 between a lower part in the slanted face 7D and the ventilation port 4A (see FIG. 3).

As shown in FIG. 2, the handle 23 is arranged in a central area in the developer cartridge 7 with regard to the widthwise direction. Meanwhile, the ventilation port 4A is, at least partly, in a lower position with respect to the handle (see FIG. 3) and in a range of the handle width W (see FIG. 2) when the opening 3C is covered by the front cover 4).

The handle width W is a range between a hypothetical vertical plane S1, which spreads through one of the widthwise ends of the handle 23, and a hypothetical vertical plane S2, which spreads through the other of the widthwise ends of the handle 23, when the developer cartridge 7 is in the attached condition.

3. Usability of the Image Forming Apparatus

According to the embodiment described above, when the developer cartridge 7 is in the attached condition, the handle 23 is in the upper position than the ventilation port 4A with regard to the vertical direction and is extended from the casing of the developer cartridge 7 toward the opening 3C, or frontward, while the facing part 24 at the vertically displaced position from the handle 23 faces the handle 23.

Figure 7:
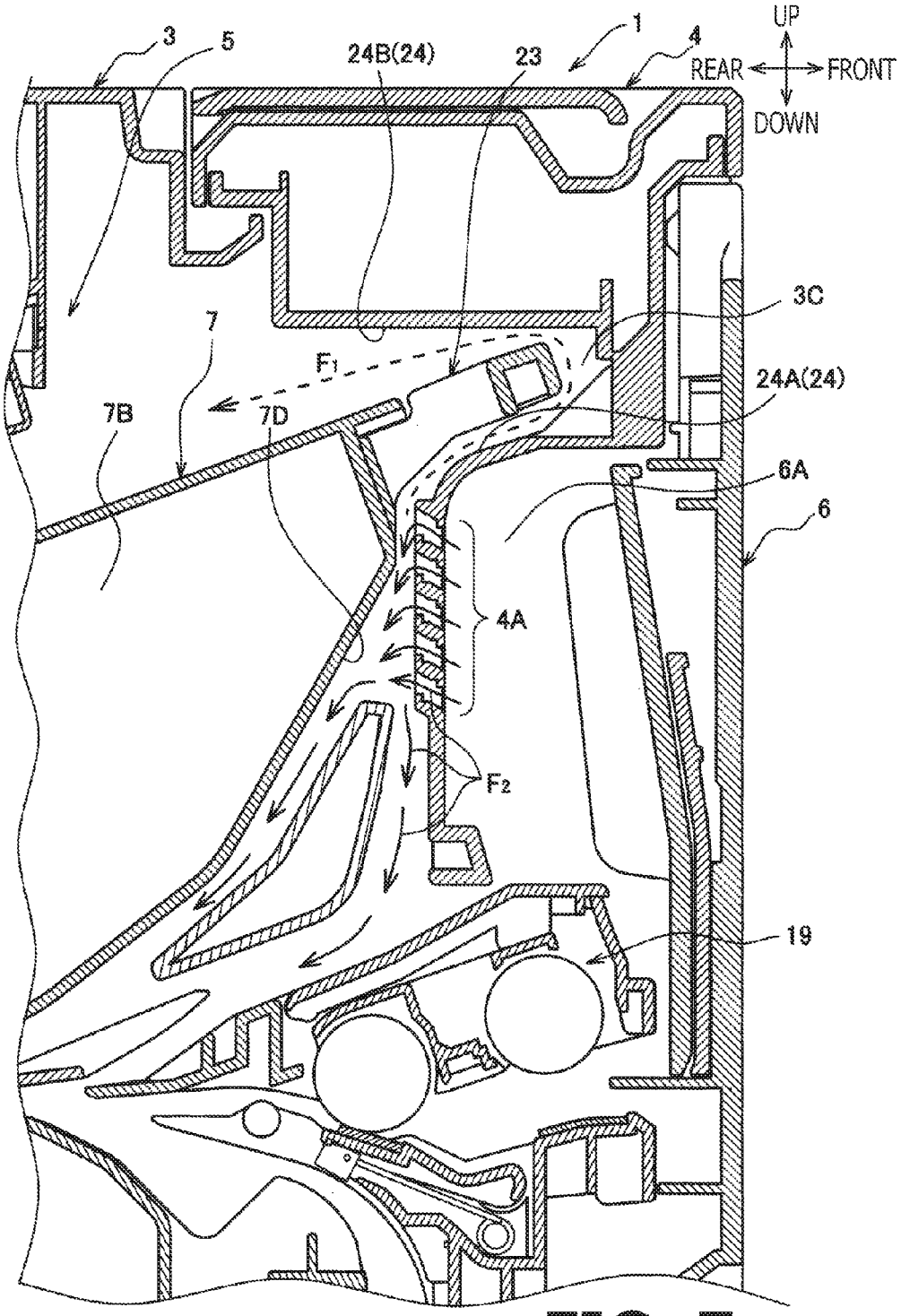
FIG. 7 is an enlarged view of a ventilation port 4A and a neighboring area in the image forming apparatus 1 according to the embodiment of the present disclosure.

While the facing part 24 faces the handle 23 at the position vertically displaced from the handle 23, as shown in FIG. 7, the air drawn inside the housing 3 through the ventilation port 4A may be restricted from flowing upward by the handle 23. Accordingly, an upward air flow indicated by a broken arrow F1 may be blocked.

Therefore, a large part of the air drawn inside the housing 3 through the ventilation port 4A may be directed downward to a lower area with respect to the developer cartridge 7. Thus, a lower part of the developer cartridge 7 may be effectively cooled.

According to the present embodiment, the facing part 24 includes the first facing part 24A at the lower position than the handle 23 and the second facing part 24B at the upper position than the handle 23. In this regard, a narrower and winding path for the air to flow around the handle 23 along the first facing part 24A and the second facing part 24B is formed. Therefore, the air drawn inside the housing 3 through the ventilation port 4A may be restricted from flowing through the narrow and winding path and may be guided downward more securely.

According to the present embodiment, meanwhile, the inlet ports 20D, 3E are provided in the position displaced from the fan 21 with regard to the conveying direction. Therefore, when the air is drawn inside the housing 3 through the inlet ports 20D, 3E to the outlet ports 20C, 3D, the air may tend to stay to be heated at a central area with regard to the widthwise direction of the developer cartridge 7, and the heated air may accumulate in the widthwise central area. In this regard, according to the present embodiment, the ventilation port 4A and the handle 23 are arranged in the central area with regard to the widthwise direction of the developer cartridge 7. Therefore, the cooling air may be drawn to the widthwise central area effectively to cool the lower area of the developer cartridge 7.

According to the present embodiment, the developer cartridge 7 has the slanted face 7D. Therefore, the air drawn inside the housing 3 through the ventilation port 4A may be guided downward along the slanted face 7D to the lower area than the developer cartridge 7 so that the lower area may be efficiently cooled.

More Examples

Although an example of carrying out the present disclosure have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the facing part 24 may not necessarily include both the first facing part 24A and the second facing part 24B but may solely have one of the first facing part 24A and the second facing part 24B that faces the handle 23 at a vertically displaced position.

For another example, the ventilation port 4A may not necessarily be arranged in the rearward position, closer to the developer cartridge 7, with respect to the extended tip end 23A of the handle 23 but may be arranged in a frontward position, farther from the developer cartridge 7, with respect to the extended tip end of the handle 23.

In this regard, when the ventilation port 4A is arranged in the frontward position with respect to the extended tip end 23A of the handle 23, a portion formed to protrude from the rearward surface of the front cover toward the developer cartridge 7 may serve as the facing part 24 (the first facing part 24A and the second facing part 24B).

For another example, the fan 21 and the inlet ports 20D, 3E may not necessarily be arranged on the opposite widthwise ends from each other but may be arranged on the same side with regard to the widthwise direction.

For another example, the developer cartridge 7 may not necessarily have the slanted face 7D but may have a face spreading in parallel with the vertical direction in place of the slanted face 7D.

For another example, the developer cartridge 7 may not necessarily have the protrusive plate 7C protruding toward the inlet ports 20D, 3E, but the protrusive plate 7C may be omitted.

What is claimed is:

1. An image forming apparatus configured to form an image electro-photographically, comprising:

a housing formed to have an opening;

a cover configured to be movable between a position to cover the opening and a position to expose the opening, the cover comprising a ventilation port, through which air is allowed to flow;

a cartridge comprising a developer roller to supply a developer agent, the cartridge being configured to be detachably attached to a body of the image forming apparatus through the opening, the cartridge further comprising a slanted face, the slanted face being arranged to face the ventilation port and slanting with respect to a vertical direction to be away from the ventilation port as the slanted face stretches downward when the cartridge is attached to the body and the opening is covered by the cover;

a discharging fan arranged on an opposite side from the opening across the cartridge;

a handle arranged on the cartridge, the handle being arranged to extend from the cartridge in a direction toward the opening in an upper position with respect to the ventilation port, when the cartridge is attached to the body and the opening is covered by the cover; and a facing part arranged on the cover, the facing part being arranged to face the handle in a vertically displaced position with respect to the handle.

2. The image forming apparatus according to claim 1, wherein the facing part comprises a first facing part arranged in a lower position with respect to the handle and a second facing part arranged in an upper position with respect to the handle.

3. The image forming apparatus according to claim 2, wherein the ventilation port is arranged in a part of the cover extending downward continuously from the first facing part.

4. The image forming apparatus according to claim 1, wherein the housing comprises an inlet port configured to draw the air into the housing;

wherein, while a direction in parallel with a rotation axis of the developer roller is a widthwise direction, and when the cartridge is attached to the body, a handle range is a range between a hypothetical vertical plane spreading through one of widthwise ends of the handle and a hypothetical vertical plane spreading through the other one of the widthwise ends of the handle, the discharging fan is arranged in the housing on one end of the handle range with regard to the widthwise direction;

wherein the inlet port is arranged on the other end of the handle range with regard to the widthwise direction on an opposite side from the discharging fan across the cartridge;

wherein the handle is arranged in a central area in the cartridge with regard to the widthwise direction; and wherein the ventilation port is at least partly in a lower position with respect to the handle and in the handle range with regard to the widthwise direction when the opening is covered by the cover.

5. The image forming apparatus according to claim 4, wherein the cartridge comprises a protrusive plate arranged on one side of the cartridge closer to the inlet port with regard to the widthwise direction, the protrusive plate protruding in a direction toward the inlet port, when the cartridge is attached to the body; and wherein the protrusive plate is arranged to spread to intersect with a vertical direction when the cartridge is attached to the body.

6. The image forming apparatus according to claim 1, wherein the ventilation port is arranged in a position closer to the cartridge than an extended end of the handle when the cartridge is attached to the body and the opening is covered by the cover.

7. An image forming apparatus configured to form an image electro-photographically, comprising:

a housing formed to have an opening;

a cover configured to be movable between a position to cover the opening and a position to expose the opening, the cover comprising a ventilation port, through which air is allowed to flow;

a cartridge comprising a developer roller to supply a developer agent, the cartridge being configured to be detachably attached to a body of the image forming apparatus through the opening;

a discharging fan arranged on an opposite side from the opening across the cartridge;

a handle arranged on the cartridge, the handle being arranged to extend from the cartridge in a direction toward the opening in an upper position with respect to the ventilation port, when the cartridge is attached to the body and the opening is covered by the cover; and a facing part arranged on the cover, the facing part being arranged to face the handle in a vertically displaced position with respect to the handle, wherein the facing part comprises a first facing part arranged in a lower position with respect to the handle and a second facing part arranged in an upper position with respect to the handle, and wherein the ventilation port is arranged in a part of the cover extending downward continuously from the first facing part.

8. An image forming apparatus configured to form an image electro-photographically, comprising:

a housing formed to have an opening and including an inlet port configured to draw air into the housing;

a cover configured to be movable between a position to cover the opening and a position to expose the opening, the cover comprising a ventilation port, through which the air is allowed to flow;

a cartridge comprising a developer roller to supply a developer agent and a protrusive plate, the cartridge being configured to be detachably attached to a body of the image forming apparatus through the opening;

a discharging fan arranged on an opposite side from the opening across the cartridge;

a handle arranged on the cartridge, the handle being arranged to extend from the cartridge in a direction toward the opening in an upper position with respect to the ventilation port, when the cartridge is attached to the body and the opening is covered by the cover; and a facing part arranged on the cover, the facing part being arranged to face the handle in a vertically displaced position with respect to the handle, wherein, while a direction in parallel with a rotation axis of the developer roller is a widthwise direction, and when the cartridge is attached to the body, a handle range is a range between a hypothetical vertical plane spreading through one of widthwise ends of the handle and a hypothetical vertical plane spreading through the other one of the widthwise ends of the handle, the discharging fan is arranged in the housing on one end of the handle range with regard to the widthwise direction, wherein the inlet port is arranged on the other end of the handle range with regard to the widthwise direction on an opposite side from the discharging fan across the cartridge;

wherein the handle is arranged in a central area in the cartridge with regard to the widthwise direction, wherein the ventilation port is at least partly in a lower position with respect to the handle and in the handle range with regard to the widthwise direction when the opening is covered by the cover, wherein the protrusive plate is arranged on one side of the cartridge closer to the inlet port with regard to the widthwise direction, the protrusive plate protruding in a direction toward the inlet port, when the cartridge is attached to the body; and wherein the protrusive plate is arranged to spread to intersect with a vertical direction when the cartridge is attached to the body.

* * * * *